US009011202B2

(12) United States Patent
David

(10) Patent No.: US 9,011,202 B2
(45) Date of Patent: Apr. 21, 2015

(54) FITTING OF OPTICAL MODEL WITH DIFFRACTION EFFECTS TO MEASURED SPECTRUM

(75) Inventor: Jeffrey Drue David, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 478 days.

(21) Appl. No.: 13/456,035

(22) Filed: Apr. 25, 2012

(65) Prior Publication Data

US 2013/0288570 A1 Oct. 31, 2013

(51) Int. Cl.
*B24B 1/00* (2006.01)
*B24B 37/013* (2012.01)
*B24B 49/12* (2006.01)

(52) U.S. Cl.
CPC ..... *B24B 49/12* (2013.01); *B24B 37/013* (2013.01)

(58) Field of Classification Search
CPC .... B24B 49/16; B24B 37/013; B24B 37/042; B24B 49/12; B24B 49/00
USPC ..... 451/5, 6, 11, 41, 285–290; 700/160, 700/173, 175
See application file for complete search history.

(56) References Cited

U.S. PATENT DOCUMENTS

| | | | | |
|---|---|---|---|---|
| 5,653,622 | A * | 8/1997 | Drill et al. | 451/5 |
| 5,658,183 | A * | 8/1997 | Sandhu et al. | 451/5 |
| 6,271,047 | B1 * | 8/2001 | Ushio et al. | 438/14 |
| 6,276,987 | B1 * | 8/2001 | Li et al. | 451/5 |
| 6,361,646 | B1 | 3/2002 | Bibby, Jr. et al. | |
| 6,489,624 | B1 | 12/2002 | Ushio et al. | |
| 6,947,135 | B2 * | 9/2005 | Johnson | 356/237.2 |
| 7,003,148 | B2 * | 2/2006 | Shiomi et al. | 382/141 |
| 7,018,271 | B2 * | 3/2006 | Wiswesser et al. | 451/8 |
| 7,264,535 | B2 * | 9/2007 | Guthrie et al. | 451/5 |
| 8,157,616 | B2 * | 4/2012 | Shimizu et al. | 451/8 |
| 8,202,738 | B2 * | 6/2012 | David et al. | 438/7 |
| 2002/0001862 | A1 | 1/2002 | Ushio et al. | |
| 2003/0045100 | A1 | 3/2003 | Saka et al. | |
| 2005/0117164 | A1 * | 6/2005 | Nomoto et al. | 356/504 |
| 2006/0252348 | A1 * | 11/2006 | Lin et al. | 451/5 |
| 2006/0274326 | A1 * | 12/2006 | Kobayashi et al. | 356/600 |
| 2008/0007740 | A1 | 1/2008 | Vuong et al. | |
| 2010/0039707 | A1 * | 2/2010 | Akahane et al. | 359/576 |
| 2010/0075576 | A1 * | 3/2010 | Kobayashi et al. | 451/5 |
| 2010/0120331 | A1 * | 5/2010 | Carlsson et al. | 451/5 |

(Continued)

OTHER PUBLICATIONS

Bischoff, "Formulation of the normal vector RCWA for symmetric crossed gratings in symmetric mountings," *J. Opt. Soc. Am. A.*, May 2010, 27(5):1024-1031.

(Continued)

*Primary Examiner* — George Nguyen
(74) *Attorney, Agent, or Firm* — Fish & Richardson P.C.

(57) ABSTRACT

A method of controlling a polishing operation includes obtaining a sequence over time of measured spectra with an in-situ optical monitoring system during polishing. For each measured spectrum from the sequence an optical model is fit. The optical model includes dimensions of a repeating structure and the fitting includes calculating a output spectrum using diffraction effects of the repeating structure, and parameters of the optical model include an endpoint parameter and a parameter of the repeating structure. The fitting generates the sequence of fitted endpoint parameter values, and at least one of a polishing endpoint or an adjustment of a pressure to the substrate is determined from the sequence of fitted endpoint parameter values.

21 Claims, 5 Drawing Sheets

(56) References Cited

U.S. PATENT DOCUMENTS

| | | | | |
|---|---|---|---|---|
| 2011/0256805 | A1 | 10/2011 | David et al. | |
| 2012/0096006 | A1 | 4/2012 | David et al. | |
| 2012/0278028 | A1 | 11/2012 | David et al. | |
| 2013/0288570 | A1 * | 10/2013 | David | 451/5 |

OTHER PUBLICATIONS

Lalanne, "Improved formulation of the coupled-wave method for two-dimensional gratings," *J. Opt. Soc. Am. A*, Jul. 1997, 14(7):1592-1598.

Li, "New formulation of the Fourier modal method for crossed surface-relief gratings," *J. Opt. Soc. Am. A*, Oct. 1997, 14(10):2758-2767.

Li, "Multilayer modal method for diffraction gratings of arbitrary profile, depth, and permittivity," *J. Opt. Soc. Am. A*, Dec. 1993, 10(12):2581-2591.

Moharam and Gaylord, "Three-dimensional vector coupled-wave analysis of planar-grating diffraction," *J. Opt. Soc. Am.*, Sep. 1983, 73(9):1105-1112.

Moharam et al., "Formulation for stable and efficient implantation of the rigorous coupled-wave analysis of binary gratings," *J. Opt. Soc. Am. A*, May 1995, 12(5):1068-1076.

Moharam et al., "Stable implementation of the rigorous coupled-wave analysis for surface-relief gratings: enhanced transmittance matrix approach," *J. Opt. Soc. Am. A*, May 1995, 12(5):1077-1086.

Zhou and Li, "Formulation of the Fourier modal method for symmetric crossed gratings in symmetric mountings," *J. Opt. A: Pure Appl. Opt.*, 2004, 6:43-50.

International Search Report and Written Opinion in International Application No. PCT/US2013/035510, mailed Jun. 26, 2013, 9 pages.

* cited by examiner

FITTING OF OPTICAL MODEL WITH DIFFRACTION EFFECTS TO MEASURED SPECTRUM

TECHNICAL FIELD

The present disclosure relates to polishing control methods, e.g., during chemical mechanical polishing of substrates.

BACKGROUND

An integrated circuit is typically formed on a substrate by the sequential deposition of conductive, semiconductive, or insulative layers on a silicon wafer. A variety of fabrication processes require planarization of a layer on the substrate. For example, for certain applications, e.g., polishing of a metal layer to form vias, plugs, and lines in the trenches of a patterned layer, an overlying layer is planarized until the top surface of a patterned layer is exposed. In other applications, e.g., planarization of a dielectric layer for photolithography, an overlying layer is polished until a desired thickness remains over the underlying layer.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as slurry with abrasive particles, is typically supplied to the surface of the polishing pad.

One problem in CMP is determining whether the polishing process is complete, i.e., whether a substrate layer has been planarized to a desired flatness or thickness, or when a desired amount of material has been removed. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, it may not be possible to determine the polishing endpoint merely as a function of polishing time.

In some systems, a substrate is optically monitored in-situ during polishing, e.g., through a window in the polishing pad. In some optical monitoring processes, a spectrum is measured in-situ, i.e., during a polishing process of CMP. However, existing optical monitoring techniques may not satisfy increasing demands of semiconductor device manufacturers.

SUMMARY

One approach to deriving endpoint data from a spectrum measured in-situ during polishing is to fit a function, e.g., an optical model, to the measured spectrum. The optical model is a function with multiple parameters, e.g. the thickness, index of refraction and extinction coefficient of each layer in the stack. The optical model generates an output spectrum based on the parameters. By fitting the optical model to the measured spectrum, the parameters are selected, e.g., by regression techniques, to provide an output spectrum that closely matches the measured spectrum.

A potential problem is that a device wafer is typically patterned, and thus includes regions with different layer stacks. An optical model may not account for the patterned nature of the device wafer, and consequently the endpoint determination may be unreliable. However, a technique to counteract this problem is to model a portion of the patterned substrate that includes different layer stacks, and calculate the diffraction effects, e.g., using Rigorous Coupled Waveform Analysis, created under the assumption that the modeled portion is repeated across the measured region of the substrate.

In one aspect, a method of controlling a polishing operation includes polishing a first layer of a substrate, during polishing obtaining a sequence over time of measured spectra with an in-situ optical monitoring system, for each measured spectrum from the sequence of measured spectra fitting an optical model to the measured spectrum, and determining at least one of a polishing endpoint or an adjustment of a pressure to the substrate from a sequence of fitted endpoint parameter values. The fitting includes finding parameters that provide a minimum difference between an output spectrum of the optical model and the measured spectrum. The optical model includes dimensions of a repeating structure and the fitting includes calculating the output spectrum using diffraction effects of the repeating structure, the parameters including an endpoint parameter and a parameter of the repeating structure. The fitting generates the sequence of fitted endpoint parameter values, each endpoint parameter value of the sequence associated with one of the spectra of the sequence of measured spectra.

Implementations may include one or more of the following features. The endpoint parameter may include a thickness of the first layer. The parameter of the repeating structure may include at least one of a width or pitch of the repeating structure. The repeating structure may include repeating lines. The parameter of the repeating structure comprises at least one of a line pitch or a linewidth. Determining at least one of a polishing endpoint or an adjustment of a pressure may include determining a resistivity of the lines. Determining a resistivity of the lines may include multiplying a value of the linewidth by a value of the thickness. The parameter of the repeating structure may include at least one of a material composition, an index of refraction or an extinction coefficient of the repeating structure. The minimum difference may be a sum of squares difference between the output spectrum and the measured spectrum. The repeating structure may include a 2-dimensional feature. The parameter of the repeating structure may include at least one of a feature pitch, a feature shape, or percentage area occupied by the feature. Calculating the output spectrum using diffraction effects may include performing rigorous coupled wave analysis (RCWA). The optical model may include a first sub-model representing a region of the substrate with a first repeating structure and a second sub-model representing a region of the substrate with a different second repeating structure, and calculating the output spectrum may include calculating a first intermediate output spectrum using diffraction effects of the first repeating structure and calculating a second intermediate output spectrum using diffraction effects of the second repeating structure, and combining the first intermediate output spectrum and the second intermediate output spectrum. Fitting may include calculating a percentage contribution of the first intermediate output spectrum and the second intermediate output spectrum that provides the minimum difference between the output spectrum of the optical model and the measured spectrum. Calculating the output spectrum using diffraction effects of the repeating structure may include calculating a first output spectrum for a first polarization, calculating a second output spectrum for a different second polarization, and combining the first output spectrum and the second output spectrum to generate the output spectrum. Combining the first output spectrum and the second output spectrum may include averaging the first output spectrum and the second output spectrum. The first polarization may be s-polarization and the second polarization may be p-polarization. Calculating the output spectrum using diffraction effects of the repeating structure may include calculating the output spectrum for a polarization at a 45° angle between s-polarization and p-polarization. A parameter of the repeating structure may include a width of a trench liner layer. The optical model may have a liner layer material, e.g., tantalum, as a lowest layer of a stack of layers represented in the optical model.

In another aspect, a non-transitory computer program product, tangibly embodied in a machine readable storage device, includes instructions to carry out the method.

Certain implementations may include one or more of the following advantages. An optical model may be fit to a measured spectrum, and an indication of when to endpoint, e.g., the thickness of a layer being polished, may be determined from the fitted parameters. The patterned nature of the substrate and diffraction effects caused by repeating features in the substrate can be accounted for in the optical model. Reliability of the endpoint system to detect a desired polishing endpoint may be improved, and within-wafer and wafer-to-wafer thickness non-uniformity (WIWNU and WTWNU) may be reduced.

BRIEF DESCRIPTION OF THE DRAWINGS

Like reference numbers and designations in the various drawings indicate like elements.

DETAILED DESCRIPTION

One optical monitoring technique is to measure spectra of light reflected from a substrate during polishing, and fit a function, e.g., an optical model, to the measured spectra. A potential problem is that a device wafer is typically patterned, and thus includes regions with different layer stacks. An optical model may not account for the patterned nature of the device substrate, and consequently the endpoint determination may be unreliable.

To account for the pattern of the device substrate, the optical model can include diffraction effects generated by a repeating feature on the substrate. The diffraction effects can be calculated using rigorous coupled waveform analysis. The repeating feature can be represented by at least one parameter. The thickness of the layer being polished can be another parameter of the optical model. By fitting the optical model to the measured spectrum, the parameters are selected, e.g., by regression techniques, to provide an output spectrum that closely matches the measured spectrum.

A substrate can include a first layer (that will undergo polishing) and a second layer disposed under the first layer. Both the first layer and the second layer are at least semi-transparent. Together, the second layer and one or more additional layers (if present) provide a layer stack below the first layer. Examples of layers include an insulator, passivation, etch stop, barrier layer and capping layers. Examples of materials in such layers include oxide, such as silicon dioxide, a low-k material, such as carbon doped silicon dioxide, e.g., Black Diamond™ (from Applied Materials, Inc.) or Coral™ (from Novellus Systems, Inc.), silicon nitride, silicon carbide, carbon-silicon nitride (SiCN), a metal nitride, e.g., tantalum nitride or titanium nitride, or a material formed from tetraethyl orthosilicate (TEOS).

Chemical mechanical polishing can be used to planarize the substrate until a predetermined thickness of the first layer is removed, a predetermined thickness of the first layer remains, or until the second layer is exposed.

Figure 1:
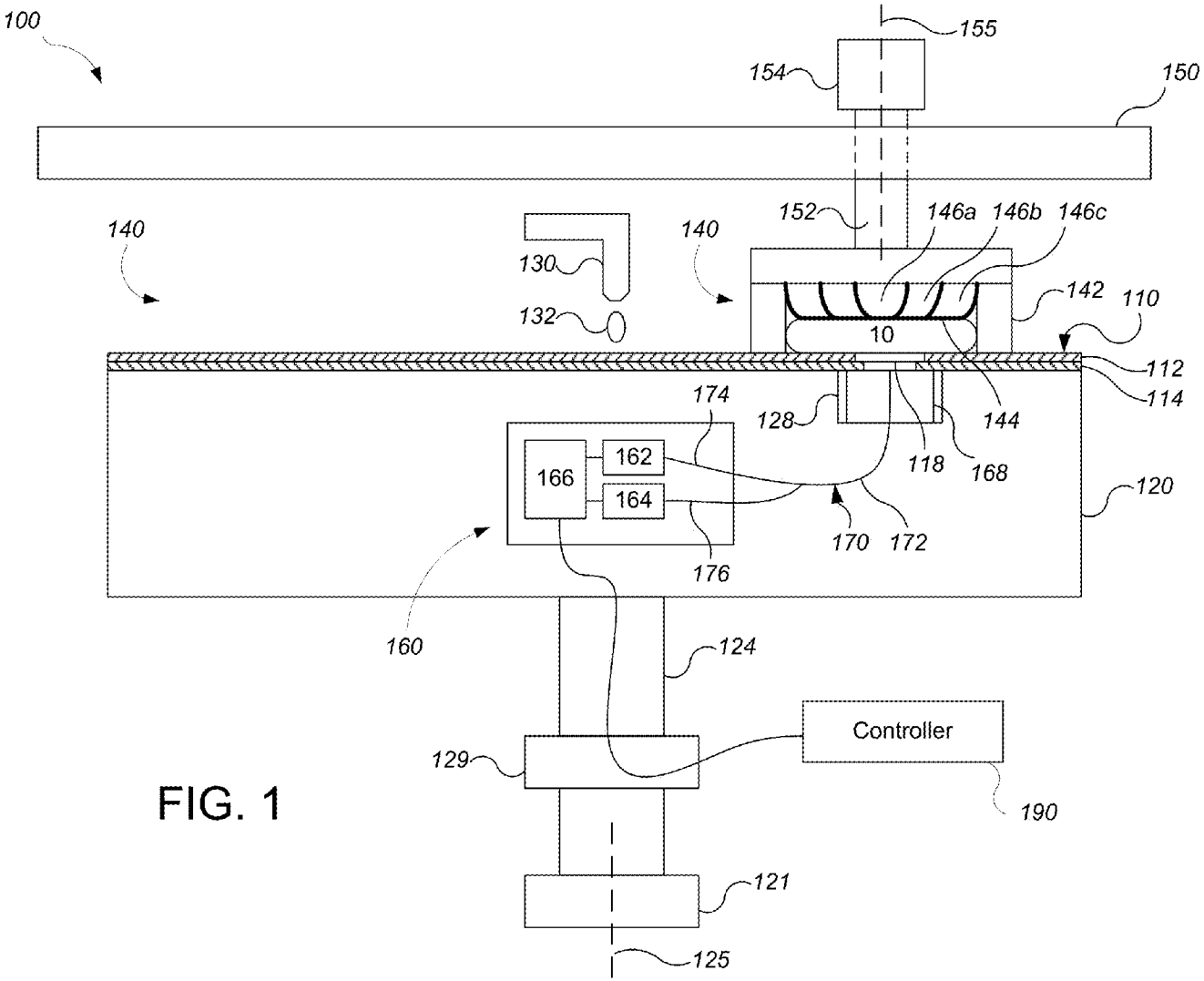
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as a slurry, onto the polishing pad 110 to the pad. The polishing apparatus can also include a polishing pad conditioner to abrade the polishing pad 110 to maintain the polishing pad 110 in a consistent abrasive state.

The polishing apparatus 100 includes one or more carrier heads 140. Each carrier head 140 is operable to hold a substrate 10 against the polishing pad 110. Each carrier head 140 can have independent control of the polishing parameters, for example pressure, associated with each respective substrate.

Figure 3:
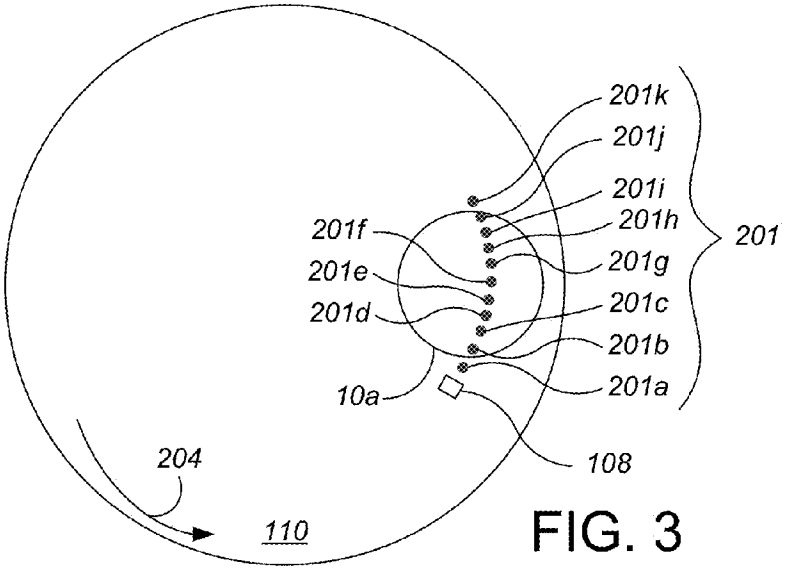
FIG. 3 illustrates a top view of a polishing pad and shows locations where in-situ measurements are taken on a substrate.
Figure 2:
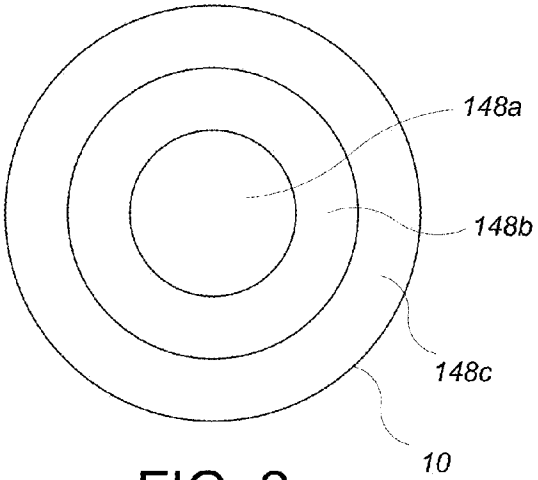
FIG. 2 illustrates a schematic top view of a substrate having multiple zones.

In particular, each carrier head 140 can include a retaining ring 142 to retain the substrate 10 below a flexible membrane 144. Each carrier head 140 also includes a plurality of independently controllable pressurizable chambers defined by the membrane, e.g., three chambers 146*a*-146*c*, which can apply independently controllable pressurizes to associated zones 148*a*-148*c* on the flexible membrane 144 and thus on the substrate 10 (see FIG. 3). Referring to FIG. 3, the center zone 148*a* can be substantially circular, and the remaining zones 148*b*-148*c* can be concentric annular zones around the center zone 148*a*. Although only three chambers are illustrated in FIGS. 1 and 2 for ease of illustration, there could be one or two chambers, or four or more chambers, e.g., five chambers.

Returning to FIG. 1, each carrier head 140 is suspended from a support structure 150, e.g., a carousel, and is connected by a drive shaft 152 to a carrier head rotation motor 154 so that the carrier head can rotate about an axis 155. Optionally each carrier head 140 can oscillate laterally, e.g., on sliders on the carousel 150; or by rotational oscillation of the carousel itself In operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

The polishing apparatus also includes an in-situ optical monitoring system 160, e.g., a spectrographic monitoring system, which can be used to determine whether to adjust a polishing rate or an adjustment for the polishing rate as discussed below. An optical access through the polishing pad is provided by including an aperture (i.e., a hole that runs through the pad) or a solid window 118. The solid window 118 can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber can include a trunk 172 positioned in proximity to the optical access, and two branches 174 and 176 connected to the light source 162 and detector 164, respectively.

In some implementations, the top surface of the platen can include a recess 128 into which is fit an optical head 168 that holds one end of the trunk 172 of the bifurcated fiber. The optical head 168 can include a mechanism to adjust the vertical distance between the top of the trunk 172 and the solid window 118.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

The light source 162 can be operable to emit white light. In one implementation, the white light emitted includes light having wavelengths of 200-800 nanometers. A suitable light source is a xenon lamp or a xenon mercury lamp.

Figure 4:
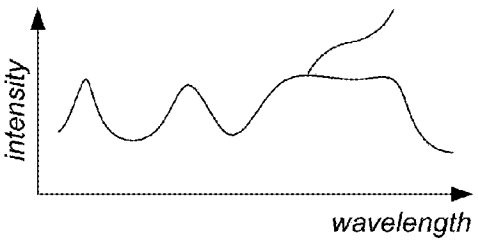
FIG. 4 illustrates a measured spectrum from the in-situ optical monitoring system.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency). FIG. 4 illustrates an example of a measured spectrum 300.

As noted above, the light source 162 and light detector 164 can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the rotation of the platen 120.

In some implementations, the light source 162 and detector 164 of the in-situ monitoring system 160 are installed in and rotate with the platen 120. In this case, the motion of the platen will cause the sensor to scan across each substrate. In particular, as the platen 120 rotates, the controller 190 can cause the light source 162 to emit a series of flashes starting just before and ending just after the optical access passes below the substrate 10. Alternatively, the computing device can cause the light source 162 to emit light continuously starting just before and ending just after each substrate 10 passes over the optical access. In either case, the signal from the detector can be integrated over a sampling period to generate spectra measurements at a sampling frequency.

In operation, the controller 190 can receive, for example, a signal that carries information describing a spectrum of the light received by the light detector for a particular flash of the light source or time frame of the detector. Thus, this spectrum is a spectrum measured in-situ during polishing.

As shown by in FIG. 3, if the detector is installed in the platen, due to the rotation of the platen (shown by arrow 204), as the window 108 travels below a carrier head, the optical monitoring system making spectra measurements at a sampling frequency will cause the spectra measurements to be taken at locations 201 in an arc that traverses the substrate 10. For example, each of points 201*a*-201*k* represents a location of a spectrum measurement by the monitoring system (the number of points is illustrative; more or fewer measurements can be taken than illustrated, depending on the sampling frequency). The sampling frequency can be selected so that between five and twenty spectra are collected per sweep of the window 108. For example, the sampling period can be between 3 and 100 milliseconds.

As shown, over one rotation of the platen, spectra are obtained from different radii on the substrate 10. That is, some spectra are obtained from locations closer to the center of the substrate 10 and some are closer to the edge. Thus, for any given scan of the optical monitoring system across a substrate, based on timing, motor encoder information, and optical detection of the edge of the substrate and/or retaining ring, the controller 190 can calculate the radial position (relative to the center of the substrate being scanned) for each measured spectrum from the scan. The polishing system can also include a rotary position sensor, e.g., a flange attached to an edge of the platen that will pass through a stationary optical interrupter, to provide additional data for determination of which substrate and the position on the substrate of the measured spectrum. The controller can thus associate the various measured spectra with the controllable zones 148*b*-148*e* (see FIG. 2) on the substrates 10*a* and 10*b*. In some implementations, the time of measurement of the spectrum can be used as a substitute for the exact calculation of the radial position.

Over multiple rotations of the platen, for each zone, a sequence of spectra can be obtained over time. Without being limited to any particular theory, the spectrum of light reflected from the substrate 10 evolves as polishing progresses (e.g., over multiple rotations of the platen, not during a single sweep across the substrate) due to changes in the thickness of the outermost layer, thus yielding a sequence of time-varying spectra. Moreover, particular spectra are exhibited by particular thicknesses of the layer stack.

The controller, e.g., the computing device, can be programmed to fit a function, e.g., an optical model, to the measured spectrum. The function has multiple input parameters, and generates an output spectrum calculated from the input parameters. The input parameters include at least a parameter from which the polishing endpoint can readily be determined, e.g., the thickness of the first layer. However, the parameter from which the polishing endpoint can readily be determined could also be a thickness removed, or more generic representation of the progress of the substrate through the polishing process, e.g., an index value representing the time or number of platen rotations at which the spectrum would be expected to be observed in a polishing process that follows a predetermined progress. In some implementations, the function is fit to each spectra in the sequence, thereby generating a sequence of fitted parameter values, e.g., a sequence of fitted thickness values.

Figure 5:
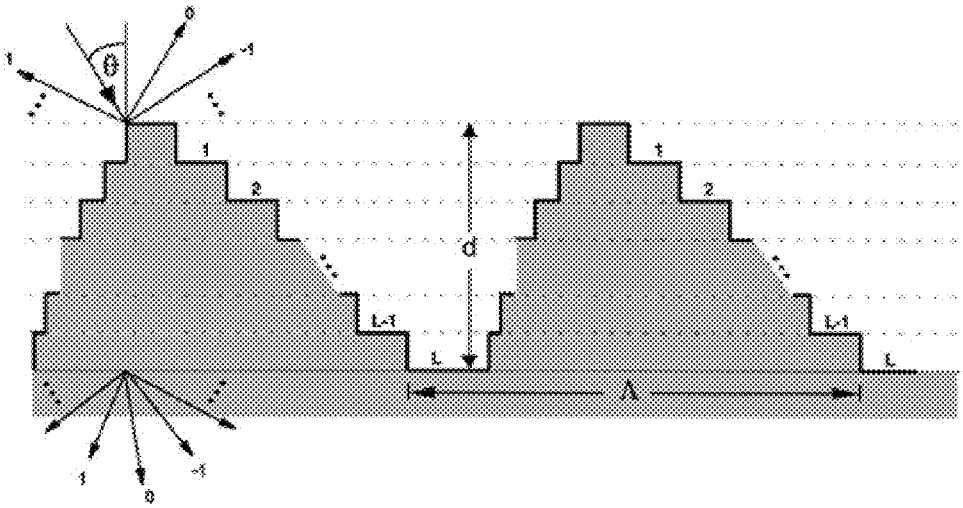
FIG. 5 illustrates a model of a portion of the substrate using a 1-dimensional model of layers of the stack.

The optical model at least partially accounts for diffraction effects generated by a repeating feature on the substrate. At least one of the input parameters represents a characteristic of the repeating feature. As shown in FIG. 5, the repeating feature can be represented with a 1-dimensional model (e.g. repeating lines and spaces). In this case, the diffracted light resulting from the repeating feature can be optically modeled with a "1-D" diffraction grating, and the input parameter can be a line width or a line pitch. This model may be appropriate for regions of the substrate having multiple parallel conductive traces.

Figure 6:
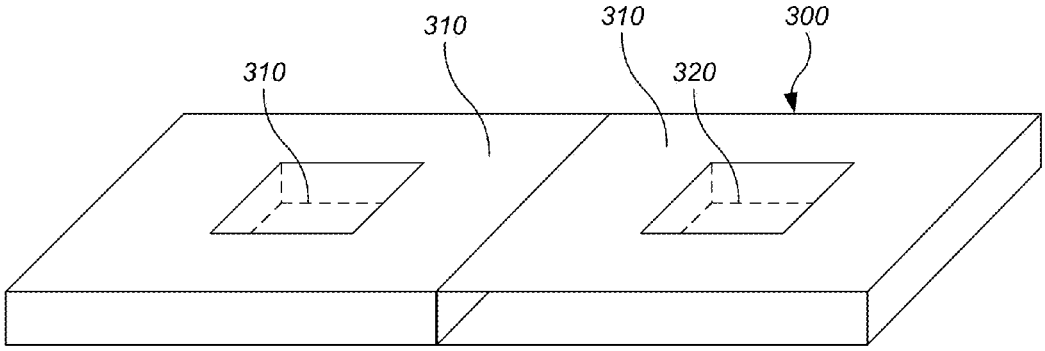
FIG. 6 illustrates a model of a portion of the substrate using a 2-dimensional model of layers of the stack.

Alternatively, referring to FIG. 6, the repeating feature can be represented with a 2-dimensional model (e.g. repeating shapes). In this case, the diffracted light resulting from the repeating feature can be optically modeled with a "2-D" diffraction grating, and the input parameter can be the feature dimension and/or the feature pitch in either or both dimensions. This model may be appropriate for regions of the substrate with repeating cells, e.g., DRAM structures. The 2-D model includes a unit cell 300 that includes a portion 310 of one material (with first optical characteristics) and a portion 320 of a different material (with different optical characteristics). Although FIG. 6 illustrates a simple 2-D parallelepiped volume of different material than the surrounding, the repeating feature can be more complex and can include multiple sub-features.

Other input parameters of the optical model can include the thickness, index of refraction and/or extinction coefficient of each of the layers.

The diffraction effects can be calculated using rigorous coupled waveform analysis. In particular, rigorous coupled waveform analysis (RCWA) can be used to model and calculate the diffraction effects. RCWA equations can be used to generate a reflectance R for each wavelength, and then to determine a diffraction efficiency at each wavelength.

Details of RCWA are laid out "Formulation for stable and efficient implementation of the rigorous coupled-wave analysis of binary gratings" by Moharam et. al, and "Stable implementation of the rigorous coupled-wave analysis for surface-relief gratings: enhanced transmittance matrix approach" by Moharam et. al., each of which is incorporated by reference.

For example, for optically modeling of a "1-D" diffraction grating, equations 24-26 from "Stable implementation of the rigorous coupled-wave analysis for surface-relief gratings: enhanced transmittance matrix approach" can be used to generate R for each wavelength, and the diffraction efficiency can be determined at each wavelength via equations 25 and 45 from "Formulation for stable and efficient implementation of the rigorous coupled-wave analysis of binary gratings."

The diffraction efficiency is normalized to the diffraction efficiency of blanket silicon to match the reflectance spectra of the in-situ monitoring system, which also is normalized to silicon to get rid of lamp, pad, and process effects. The silicon-normalized diffraction efficiency is then compared to the measured spectra.

Modeling diffracted light for a 2-D structure is more complicated, but similar in technique, extrapolated from a 1-D line to a 2-D plane.

The method described above is not the only way and not necessarily the fastest or most accurate way to determine the diffraction efficiency of a 1-D or 2-D structure. There are alternative techniques, e.g., described in "Multilayer modal method for diffraction gratings of arbitrary profile, depth, and permittivity" by Lifeng Li. But in these various techniques, the model includes diffraction caused by the repeating structure.

For at least two of the parameters, parameters values are calculated that provide a minimum difference between an output spectrum of the optical model and the measured spectrum. A first of the at least two parameters includes the parameter from which the polishing endpoint can readily be determined, e.g., the thickness of the first layer. A second of the at least two parameters can be an input parameter that represents a dimensional characteristic of the repeating feature. For example, the second of the at least two parameters can be a linewidth of the repeating feature. Other possibilities for the second of the at least two parameters include the line pitch, the area density of a material of the feature (e.g. how much of the area of the device being modeled is consumed by a given material), or the vertical shape and depth of structures (e.g. is a copper line best modeled as square, or is it tapered with depth).

In an example, to account for an array of traces on the substrate, the input parameters include the angle of incidence of the light, (e.g. zero degrees), the pitch of the traces, the number of layers modeled, the thickness of each layer, the linewidth of the traces, the n and k values of the input and output planes, the n and k values of the feature(s) and the region(s) outside the feature(s) (e.g., the ridge and groove) for each layer, and the wavelength range analyzed. The values for the thickness of the outermost layer and the linewidth that provide the minimum difference between an output spectrum of the optical model and the measured spectrum is determined.

Some of the input parameters can have fixed values. Some of the input parameters can be permitted to vary; these are the parameters for which values will be determined as part of the fitting process. Those input parameters for which values are determined as part of the fitting can be limited to variation between predetermined ranges. The ranges for the input parameters can be chosen to 1) avoid degenerative fits, and 2) to keep calculation time at a reasonable level. If the allowed range for a value of an input parameter is too great, the likelihood of a degenerative fit increases. A user can input into the model the nominal parameter values for some of the parameters (e.g. line width, expected thickness, and index of refraction and extinction coefficient for various materials). The user can also input into the model the permitted ranges for some of the parameter values. These nominal values and ranges can be based on the user's knowledge of the device/layer being polished.

As noted above, some boundary conditions can be imposed on the parameters. For example, the thickness t for a layer j can be permitted to vary between a minimum value $T_{MINj}$ and a maximum value $T_{MAXj}$. Similar boundary conditions can be imposed on the parameters that are material properties, e.g., index of refraction (n), extinction coefficient (k), and/or on parameters that are structural properties, e.g., the line width. The boundary values can be input by the operator based on knowledge of variation within the fabrication process.

In some implementations, the input parameters are fed directly into equations of the optical model. However, in some implementations the input parameters can be used to generate a plurality of pixel grids. Each layer of the device that has a different 2-D pattern is modeled with its own pixel grid, so that the 3-D device is represented by a stack of pixel grids. Each pixel grid in the stack can be assigned its own thickness. The grid is a user-defined size in the x and y directions, and the scale of the pixels can also be user-defined. Each pixel in a grid is assigned a refractive index and an extinction coefficient based on the material in the pixel. The diffraction is then calculated based on the array of pixels. By combining the a series of grid slices, one can model any device in 3 dimensions.

For example, to model a region of repeating lines, the input parameters could include the linewidth and pitch of the lines, and the material composition of the lines and the material composition of the region between the lines. A pixel array would then be generated; a determination of whether the pixel is part of the line or part of the region between the lines is made based on the linewidth and pitch. If the pixel is part of the line, then it would be assigned index of refraction and extinction coefficient values for the material composition of the line. If the pixel is not part of the line, then it would be assigned index of refraction and extinction coefficient values for the material composition of the region between the lines.

In some implementations, the optical model models the presence of a metal line. However, a metal liner material, e.g. Tantalum, can be used to model the metal contribution instead of the material of the metal line, e.g., copper. Although it may be possible to completely model both the liner and the copper which lies below or next to the liner, but this may be too complicated or computationally intensive; the model can be simplified and computation time reduced if the liner material only is used.

Some in-line metrology systems illuminate a substrate with polarized light beams at multiple different angles of incidence. In contrast, the in-situ monitoring system illuminates the substrate with unpolarized light. In addition, the unpolarized light can be at a single angle of incidence.

In order to account for the unpolarized light, the calculation of the output spectrum can include calculation of a first spectrum for a first polarization of light and calculation of a second spectrum for a second polarization of light. For example, the first polarization can be s-polarization and the second polarization can be p-polarization. The calculation of the first spectrum and the second spectrum can otherwise be conducted with identical values for the input parameters. The first spectrum and the second spectrum can then be averaged to generate the output spectrum.

Alternatively, just a single spectrum could be calculated using a polarization intermediate the s and p polarizations, e.g., calculating using a polarization at an angle of 45°. Alternatively, three or more spectra can be calculated for different polarizations, and the three or more spectra can be averaged to generate the output spectrum. Increasing the number of angles of polarization might improve accuracy of the model.

In some implementations, the optical model can include multiple optical sub-models. Each optical sub-model operates as the optical model described above, e.g., with various input parameters, but the different sub-model represent regions of different patterning on the substrate. Since the patterning is different, the effect of diffraction will be different, and the resulting spectrum will be different. Each sub-model can generate an intermediate spectrum, and the intermediate spectra can be combined to generate the output spectrum. The relative weight, e.g., percentage contribution, of each intermediate spectrum can be one of the parameters that is calculated as part of the fitting process.

This permits the optical model to account for the possibility that the light beam will illuminate regions with different patterns on the substrate. Thus the model can provide one output spectrum that would be generated if the light happened to be collected from two structures simultaneously, e.g. if the light spot rested halfway on one structure and halfway on a different structure. For example, if the light spot was halfway on a 1-D grating that had a pitch A and the other half of the light spot was halfway on a structure of pitch B, then the proper model for such a reflectance spectrum would be one that was a combination of each with equal weighting for both.

In fitting the optical model to the measured spectrum, the parameters are selected to provide an output spectrum that is a close match to the measured spectrum. A close match can be considered to be the calculation of a minimum difference between the output spectrum and the measured spectrum, given the available computational power and time constraints. The thickness of the layer being polished can then be determined from the thickness parameter.

Calculation of a difference between the output spectrum and the measured spectrum can be a sum of absolute differences between the measured spectrum and the output spectrum across the spectra, or a sum of squared differences between the measured spectrum and the reference spectrum. Other techniques for calculating the difference are possible, e.g., a cross-correlation between the measured spectrum and the output spectrum can be calculated.

Fitting the parameters to find the closest output spectrum can be considered an example of finding a global minima of a function (the difference between the measured spectrum and the output spectrum generated by the function) in a multidimensional parameter space (with the parameters being the variable values in the function). For example, where the function is an optical model, the parameters can include the thickness, the index of refraction (n) and extinction coefficient (k) of the layers.

Regression techniques can be used to optimize the parameters to find a local minimum in the function. Examples of regression techniques include Levenberg-Marquardt (L-M)—which utilizes a combination of Gradient Descent and Gauss-Newton; Fminunc( )—a matlab function; lsqnonlin( )—matlab function that uses the L-M algorithm; and simulated annealing. In addition, non-regression techniques, such as the simplex method, can be used to optimize the parameters.

A potential problem with using regression or non-regression techniques alone to fine a minimum is that there may be multiple local minima in the function. If regression is commenced near the a local minima that is not the global minima, then the wrong solution may be determined as regression techniques will only go "downhill" to the best solution. However, if multiple local minima are identified, regression could be performed on all of these minima and the best solution would be identified by the one with the least difference. An alternative approach would be to track all solutions from all local minima over a period of time, and determine which is the best one over time. Examples of techniques to identify global minima include genetic algorithms; multi-start (running the regression techniques from multiple starting points with parallel computing); global search—a Matlab function; and pattern searching.

The output of fitting process is a set of fitted parameters, including at least the parameters which the polishing endpoint can readily be determined, e.g., the thickness parameter of the layer being polished. However, as noted above, the fitted parameter could also be an index value representing the time or number of platen rotations at which the spectrum would be expected to be observed in a polishing process that follows a predetermined progress.

Rather than thickness, some other metric can be calculated using one or more the parameters that represent dimensions of the structure in the layer being polished. For example, the line width can be one of the parameters that is fitted, i.e., the line width is permitted to vary in the fitting process. Since the fitting is performed for each measured spectrum, this generates a sequence of parameter values that represent dimensions of the structure, e.g., a sequence of line width values.

In some implementations, for each measured spectrum, a metal line resistivity value Rs is calculated, e.g., by multiplying the layer thickness value by the line width value. This generates a sequence of metal line resistivity values. The endpoint can be determined from the sequence of metal line resistivity values.

Figure 7:
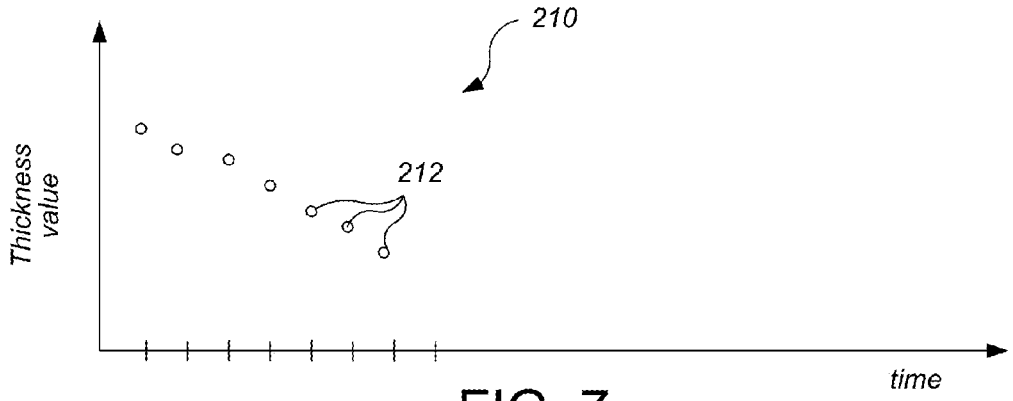
FIG. 7 illustrates an index trace.

Now referring to FIG. 7, which illustrates the results for only a single zone of a single substrate, the sequence of fitted endpoint parameter values, e.g., thickness values or resistance values, generated by fitting the optical model function to the sequence of measured spectra generates a time-varying sequence of values 212. This sequence of values 212 can be termed a trace 210. In general, the trace 210 can include one, e.g., exactly one, value per sweep of the optical monitoring system below the substrate.

Figure 8:
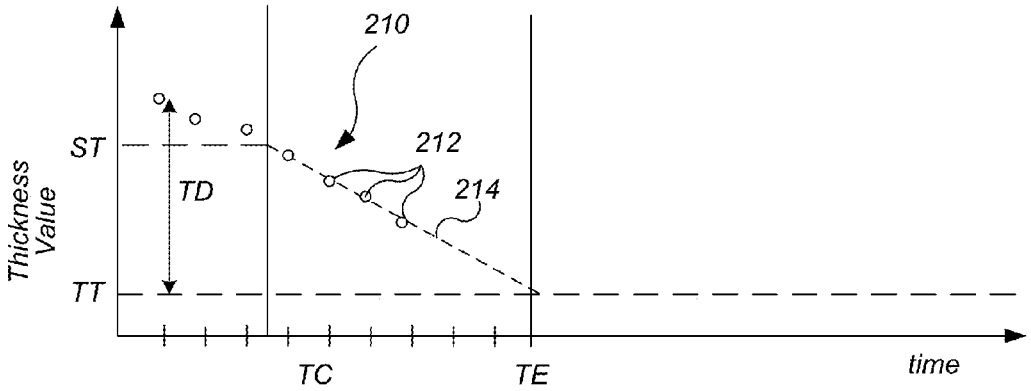
FIG. 8 illustrates an index trace having a linear function fit to index values collected after clearance of an overlying layer is detected.

As shown in FIG. 8, optionally a function, e.g., a polynomial function of known order, e.g., a first-order function (e.g., a line 214) is fit to the sequence of values derived from the measured spectra. The function can be fit using robust line fitting. Other functions can be used, e.g., polynomial functions of second-order, but a line provides ease of computation.

Optionally, the function can be fit to the values collected after time TC. Values for spectra collected before the time TC can ignored when fitting the function to the sequence of values. This can assist in elimination of noise in the measured spectra that can occur early in the polishing process, or it can remove spectra measured during polishing of another layer.

Polishing can be halted at an endpoint time TE that the line 214 crosses a target value TT. Alternatively, polishing can be halted simply at the time that the sequence of values cross the target value, e.g., without fitting any function to the sequence.

Figure 9:
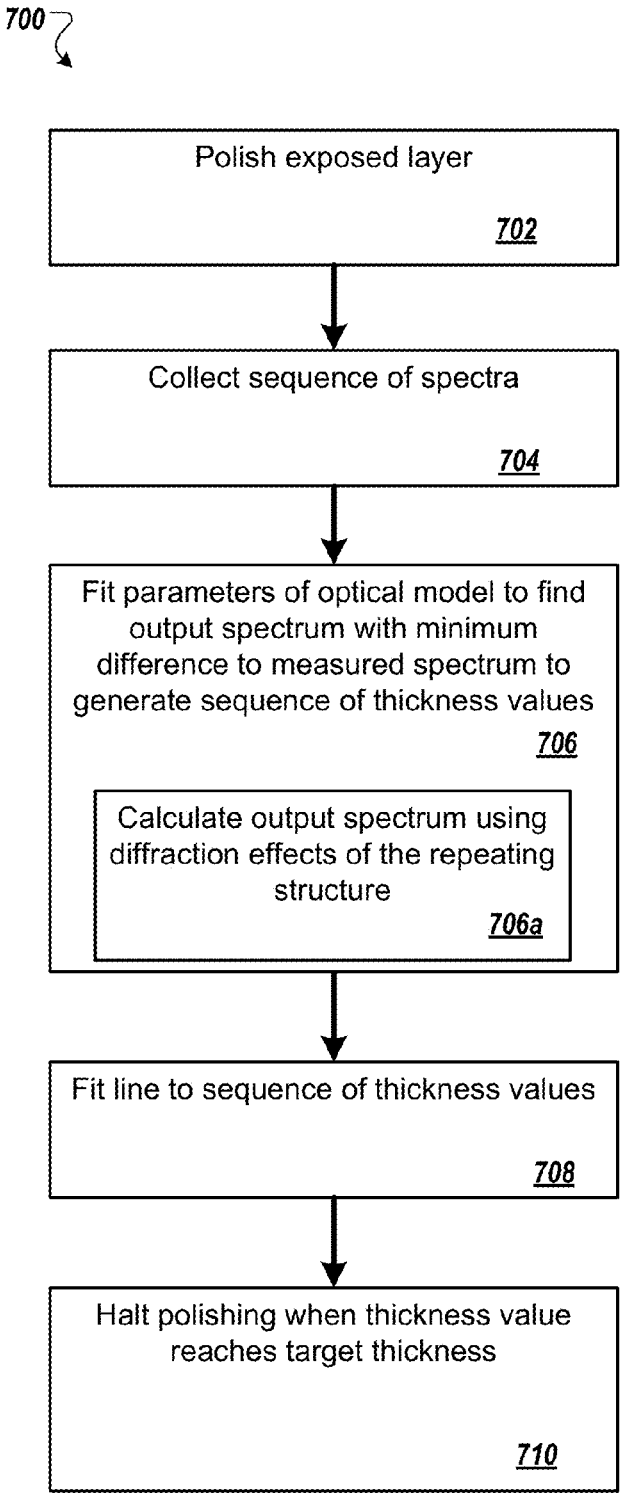
FIG. 9 is a flow diagram of an example process for controlling a polishing operation.

FIG. 9 shows a flow chart of a method 700 of polishing a product substrate. The product substrate can have at least the same layer structure as what is represented in the optical model.

The product substrate is polished (step 702), and a sequence of measured spectra are obtained during polishing (step 704), e.g., using the in-situ monitoring system described above. There may be a variety of preliminary polishing steps prior to obtaining the sequence of measured spectra. For example, one or more overlying layers can be removed, e.g., a conductive layer or dielectric layer, and measuring of the spectra can be triggered when removal of the overlying layer and clearance of the first layer is detected. For example, exposure of the first layer at a time TC (see FIG. 6) can be detected by a sudden change in the motor torque or total intensity of light reflected from the substrate, or from dispersion of the collected spectra.

The parameters of the optical model are fitted to each measured spectrum from the sequence to generate an output spectrum with minimal difference to the measured spectrum, thereby generating a sequence of values (step 706). Fitting the parameters to the measured spectrum includes calculating the output spectrum using diffraction effects of the repeating structure (step 706*a*).

Optionally, a function, e.g., a linear function, is fit to the sequence of values for the measured spectra (step 708). Polishing can be halted once the endpoint value (e.g., a calculated parameter value, e.g., a thickness value, generated from the linear function fit to the sequence of parameter values) reaches a target value (step 710). For example, in the context of thickness as the endpoint parameter, the time at which the linear function will equal the target thickness can be calculated. The target thickness TT can be set by the user prior to the polishing operation and stored. Alternatively, a target amount to remove can be set by the user, and a target thickness TT can be calculated from the target amount to remove. For example, a thickness difference TD can be calculated from the target amount to remove, e.g., from an empirically determined ratio of amount removed to the index (e.g., the polishing rate), and adding the thickness difference TD to the starting thickness ST at the time TC that clearance of the overlying layer is detected (see FIG. 6).

It is also possible to use sequences of thickness values from different zones of the substrate to adjust the pressure applied in the chambers of the carrier head to provide more uniform polishing, e.g., using techniques described in U.S. application Ser. No. 13/096,777, incorporated herein by reference (in general, the thickness value can be substituted for the index value to use similar techniques). In some implementations, the sequence of thickness values is used to adjust the polishing rate of one or more zones of a substrate, but another in-situ monitoring system or technique is used to detect the polishing endpoint.

In addition, although the discussion above assumes a rotating platen with an optical endpoint monitor installed in the platen, system could be applicable to other types of relative motion between the monitoring system and the substrate. For example, in some implementations, e.g., orbital motion, the light source traverses different positions on the substrate, but does not cross the edge of the substrate. In such cases, the collected spectra can still be grouped, e.g., spectra can be collected at a certain frequency and spectra collected within a time period can be considered part of a group. The time period should be sufficiently long that five to twenty spectra are collected for each group.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A method of controlling a polishing operation, comprising:

polishing a first layer of a substrate;

during polishing, obtaining a sequence over time of measured spectra with an in-situ optical monitoring system;

for each measured spectrum from the sequence of measured spectra, fitting an optical model to the measured spectrum, the fitting including finding parameters that provide a minimum difference between an output spectrum of the optical model and the measured spectrum, wherein the optical model includes dimensions of a repeating structure and the fitting includes calculating the output spectrum using diffraction effects of the repeating structure, the parameters including an endpoint parameter and a parameter of the repeating structure, the fitting generating a sequence of fitted endpoint parameter values, each endpoint parameter value of the sequence of fitted endpoint parameter values associated with one of the spectra of the sequence of measured spectra; and determining at least one of a polishing endpoint or an adjustment of a pressure to the substrate from the sequence of fitted endpoint parameter values.

2. The method of claim 1, wherein the endpoint parameter comprises a thickness of the first layer.

3. The method of claim 2, wherein the parameter of the repeating structure comprises at least one of a width or pitch of the repeating structure.

4. The method of claim 3, wherein the repeating structure comprises repeating lines, and wherein determining at least one of the polishing endpoint or the adjustment of the pressure comprises determining a resistivity of the lines.

5. The method of claim 4, wherein determining the resistivity of the lines comprises multiplying a value of a linewidth of the lines by a value of the thickness.

6. The method of claim 2, wherein the parameter of the repeating structure comprises at least one of a material composition, an index of refraction or an extinction coefficient of the repeating structure.

7. The method of claim 1, wherein the minimum difference comprises a sum of squares difference between the output spectrum and the measured spectrum.

8. The method of claim 1, wherein the repeating structure comprises repeating lines.

9. The method of claim 8, wherein the parameter of the repeating structure comprises at least one of a pitch of the lines or a linewidth of the lines.

10. The method of claim 1, wherein the repeating structure comprises a 2-dimensional feature.

11. The method of claim 10, wherein the parameter of the repeating structure comprises at least one of a feature pitch, a feature shape, or percentage area occupied by the feature.

12. The method of claim 1, wherein calculating the output spectrum using diffraction effects comprises performing rigorous coupled wave analysis (RCWA).

13. The method of claim 1, wherein the optical model comprises a first sub-model representing a region of the substrate with a first repeating structure and a second sub-model representing a region of the substrate with a different second repeating structure, and calculating the output spectrum includes calculating a first intermediate output spectrum using diffraction effects of the first repeating structure and calculating a second intermediate output spectrum using diffraction effects of the second repeating structure, and combining the first intermediate output spectrum and the second intermediate output spectrum.

14. The method of claim 13, wherein fitting includes calculating a percentage contribution of the first intermediate output spectrum and the second intermediate output spectrum that provides the minimum difference between the output spectrum of the optical model and the measured spectrum.

15. The method of claim 1, wherein calculating the output spectrum using diffraction effects of the repeating structure includes calculating a first output spectrum for a first polarization, calculating a second output spectrum for a different second polarization, and combining the first output spectrum and the second output spectrum to generate the output spectrum.

16. The method of claim 15, wherein combining the first output spectrum and the second output spectrum comprises averaging the first output spectrum and the second output spectrum.

17. The method of claim 15, wherein the first polarization is s-polarization and the second polarization is p-polarization.

18. The method of claim 1, wherein calculating the output spectrum using diffraction effects of the repeating structure includes calculating the output spectrum for a polarization at a 45° angle between s-polarization and p-polarization.

19. The method of claim 1, wherein the parameter of the repeating structure comprises a width of a trench liner layer.

20. The method of claim 1, wherein the optical model includes a liner layer material as a lowest layer of a stack of layers represented in the optical model.

21. A computer program product for controlling a polishing operation, the computer program product tangibly embodied in a non-transistory computer readable medium and comprising instructions for causing a processor to:

during polishing of a first layer of a substrate, receive a sequence over time of measured spectra from an in-situ optical monitoring system;

for each measured spectrum from the sequence of measured spectra, fit an optical model to the measured spectrum, the instructions to fit including instructions to find parameters that provide a minimum difference between an output spectrum of the optical model and the measured spectrum, wherein the optical model includes dimensions of a repeating structure and the instructions to fit include instructions to calculate the output spectrum using diffraction effects of the repeating structure, the parameters including an endpoint parameter and a parameter of the repeating structure, wherein the instructions to fit generate a sequence of fitted endpoint parameter values, each endpoint parameter value of the sequence of fitted endpoint parameter values associated with one of the spectra of the sequence of measured spectra; and determine at least one of a polishing endpoint or an adjustment of a pressure to the substrate from the sequence of fitted endpoint parameter values.

* * * * *